US007605772B2

(12) United States Patent
Syrstad

(10) Patent No.: US 7,605,772 B2
(45) Date of Patent: Oct. 20, 2009

(54) ELECTRONIC DISPLAY PANEL

(75) Inventor: John W. Syrstad, Rutland, SD (US)

(73) Assignee: Daktronics, Inc., Brookings, SD (US)

( * ) Notice: Subject to any disclaimer, the term of this patent is extended or adjusted under 35 U.S.C. 154(b) by 693 days.

(21) Appl. No.: 11/227,599

(22) Filed: Sep. 15, 2005

(65) Prior Publication Data

US 2006/0279493 A1 Dec. 14, 2006

Related U.S. Application Data

(63) Continuation-in-part of application No. 11/148,461, filed on Jun. 9, 2005.

(51) Int. Cl.
*G09G 5/00* (2006.01)

(52) U.S. Cl. ..... 345/1.3; 345/76; 345/77; 345/82; 345/83; 315/169.3

(58) Field of Classification Search ..... 345/82, 345/83, 76, 77; 315/169.3
See application file for complete search history.

(56) References Cited

U.S. PATENT DOCUMENTS 3,291,975 A * 12/1966 McCullough et al. ..... 362/235
3,310,901 A 3/1967 Sarkisian
5,410,328 A * 4/1995 Yoksza et al. ..... 345/82
6,314,669 B1 * 11/2001 Tucker ..... 40/448
6,741,222 B1 * 5/2004 Tucker ..... 345/1.1
6,813,853 B1 * 11/2004 Tucker ..... 40/448
7,071,620 B2 * 7/2006 Devos et al. ..... 313/512
7,448,154 B1 11/2008 Kludt
2002/0093799 A1 * 7/2002 Federer et al. ..... 361/759
2004/0104871 A1 * 6/2004 Boldt, Jr. et al. ..... 345/82

* cited by examiner

*Primary Examiner*—Richard Hjerpe
*Assistant Examiner*—Gregory J Tryder
(74) *Attorney, Agent, or Firm*—Schwegman, Lundberg & Woessner, P.A.

(57) ABSTRACT

An electronic display panel having a combination of aligned and connected forwardly located panels to which a plurality of rearwardly located LED modules easily and readily secure using three-point attachment to form an electronic display panel suitable for accommodation by and for securing to the structure and framework of a sign system. Configured spacer brackets offer mutual spaced support between the front and rear panels and are constructed using arcuate geometry for dimension minimalizing to prevent interference with the viewing of the LED pixels. Notches are located along the bottom edge of the electronic display panel for simple engagement, such as with an arcuate surface of a pivot bar incorporated in a lower structure of a sign system.

31 Claims, 16 Drawing Sheets

ELECTRONIC DISPLAY PANEL

CROSS REFERENCES TO RELATED APPLICATIONS

This patent application is a continuation-in-part of application Ser. No. 11/148,461 entitled "Sign System" filed on Jun. 09, 2005, which is pending.

BACKGROUND OF THE INVENTION

1. Field of the Invention

The present invention is for an electronic display panel, and more particularly, pertains to a modularized electronic display panel easily and readily installed for use in a sign system.

2. Description of the Prior Art

Prior art electronic display panels have often been large expansive displays utilizing a continuous collection of front, mid and rear panels to achieve the wide breadths thereof. Such large and expansive panels are often cumbersome and difficult to handle because of physical size and weight. Also, they often present problems associated with changeout of components. In particular, if multiple LED panels and support structure were incorporated, a plurality of fastening hardware pieces had to be removed before any substitution of components could occur followed by reinstallation of the fastening hardware pieces after substitution of a new component. Other problems relate to maintaining a flat and planar well supported frontal viewing area over such an expansive viewing site. In the event that prior art electronic displays incorporated multiple panels across a large viewing area, the juxtaposing of individual display panels presented the problem of maintaining a continuous display without having undesirable spacing between the visually sensed LED pixels. The present invention provides an electronic display panel which overcomes these and many other shortcomings of the prior art.

SUMMARY OF THE INVENTION

The general purpose of the present invention is to provide an electronic display panel for use in a sign system.

According to one embodiment of the present invention, there is provided an electronic display panel having a combination of aligned and connected forwardly located components and a plurality of rearwardly located LED (light emitting diode) modules easily and readily secured to the combination of aligned and connected forwardly located components. The major forwardly located components include in order from front to back a front panel, a polycarbonate panel, a seal, spacer brackets, and a rear panel and rearwardly located LED (light emitting diode) modules. The rearwardly located LED modules include an insertion panel having offset tabs and an opposed latch which readily engage the rear panel of the forwardly located components in three-point attachment. The geometry of the forwardly located components and the rearwardly located components is configured together or separately to offer minimum dimension structure where panels or edges of panels are mated and/or joined. Such dimension minimalizing allows uniform spacing of the LED pixels across each of the adjacent LED modules, as well as across adjoining forwardly located components. The spacer brackets are configured in a manner to offer mutual spaced support between the front and rear forwardly located panels and also are constructed for dimension minimalizing such that they will not interfere with the viewing of the LEDs. Notches are located along the bottom edge of the electronic display panel for simple engagement, such as with an arcuate surface of a pivot bar incorporated in the lower structure of a sign system. The geometry of the upper region of the electronic display panel is suitable for accommodation by and for securing to the upper structure of a sign system.

One significant aspect and feature of the present invention is an electronic display panel which can be easily and readily accommodated by and attached using minimal personnel to the frontal geometry of an electronic sign system.

Another significant aspect and feature of the present invention is an electronic display panel which is geometrically configured using close fitting design to provide a seamless LED display presentation having uniform LED spacing.

Another significant aspect and feature of the present invention is an electronic display panel having notched bottom structure for engagement with the lower structure of an electronic sign system.

Still another significant aspect and feature of the present invention is an electronic display panel having spacer brackets having recesses and which are joined as an assembly to maximize strength along and about the general structure while still allowing maximum viewing of LED pixels.

Yet another significant aspect and feature of the present invention is an electronic display panel having a rear panel featuring square viewing openings for the purpose of weight reduction and for providing access to the interior of the electronic display panel for cleaning of the interior of the electronic display panel.

A further significant aspect and feature of the present invention is the use of LED modules which simply and readily attach or detach from a rear panel.

A still further significant aspect and feature of the present invention is the use of LED modules having three-point attachment to the rear panel.

A still further significant aspect and feature of the present invention is an electronic display panel wherein individual LED modules include offset tabs which capturingly engage tab receptors of a rear panel and a rotatable latch which engages a latch receptor.

Having thus briefly described an embodiment of the present invention and having mentioned some significant aspects and features of the present invention, it is the principal object of the present invention to provide an electronic display panel.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
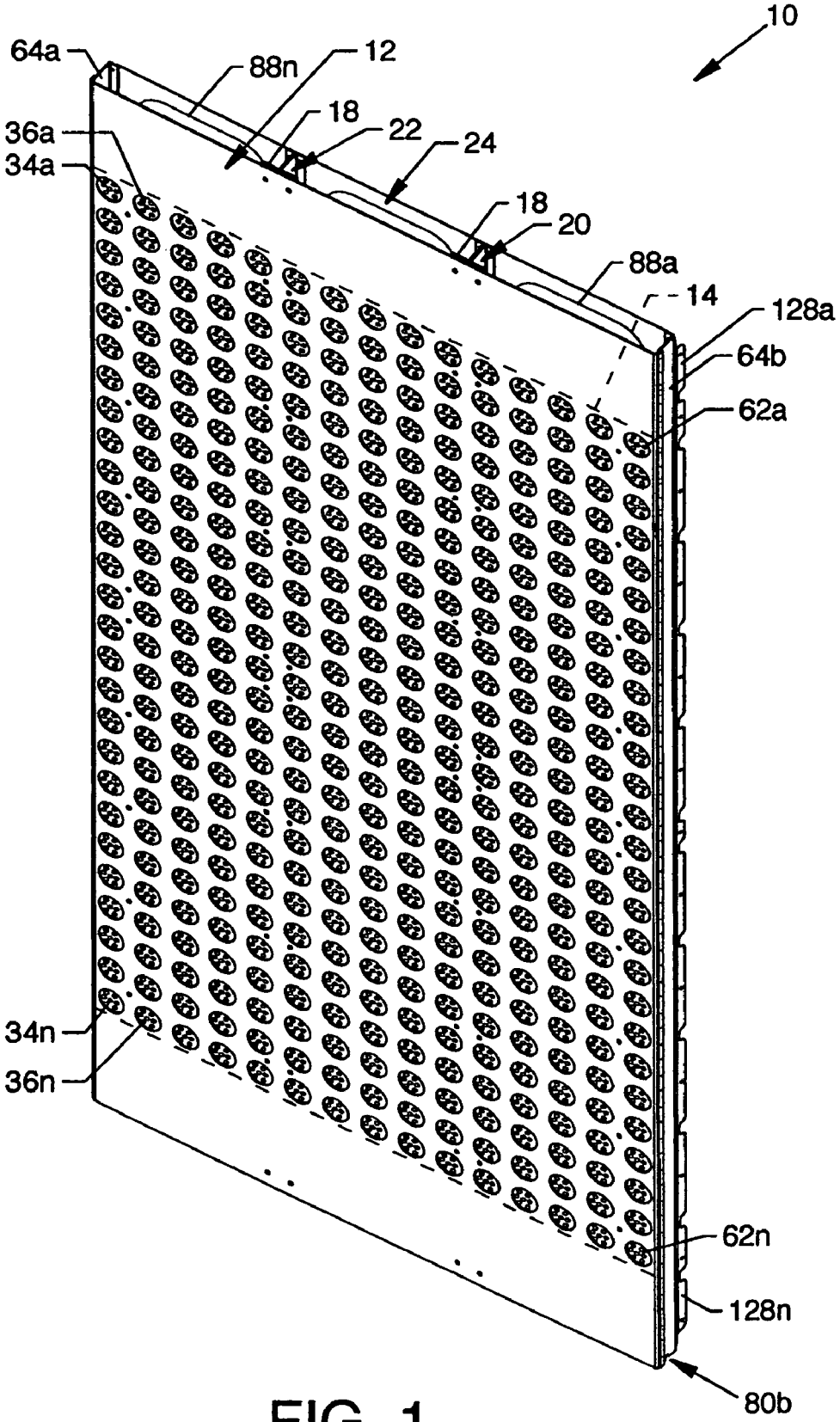
FIG. 1 is an isometric front view of an electronic display panel, the present invention.
Figure 2:
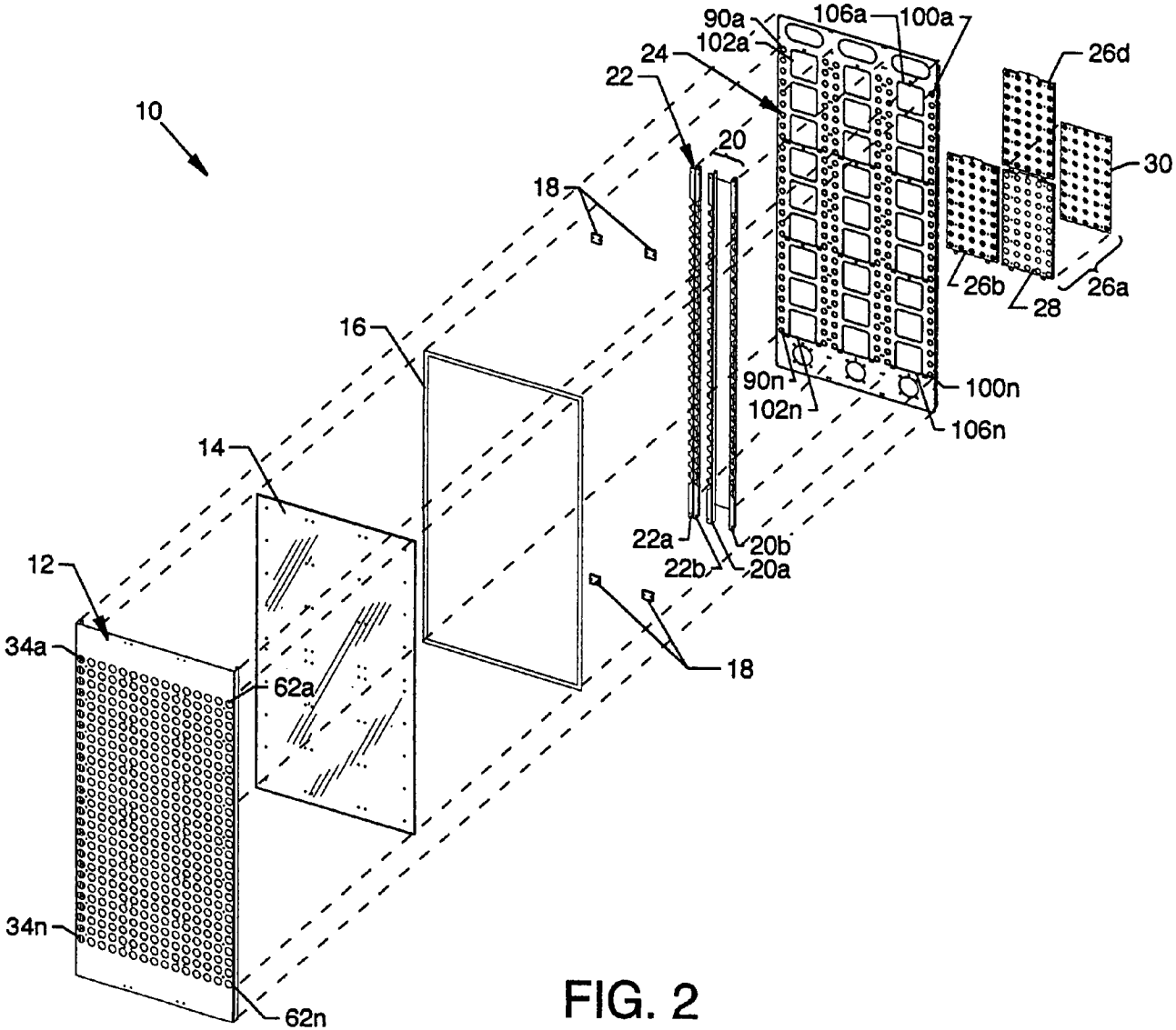
FIG. 2 is an exploded isometric front view of the electronic display panel.
Figure 3:
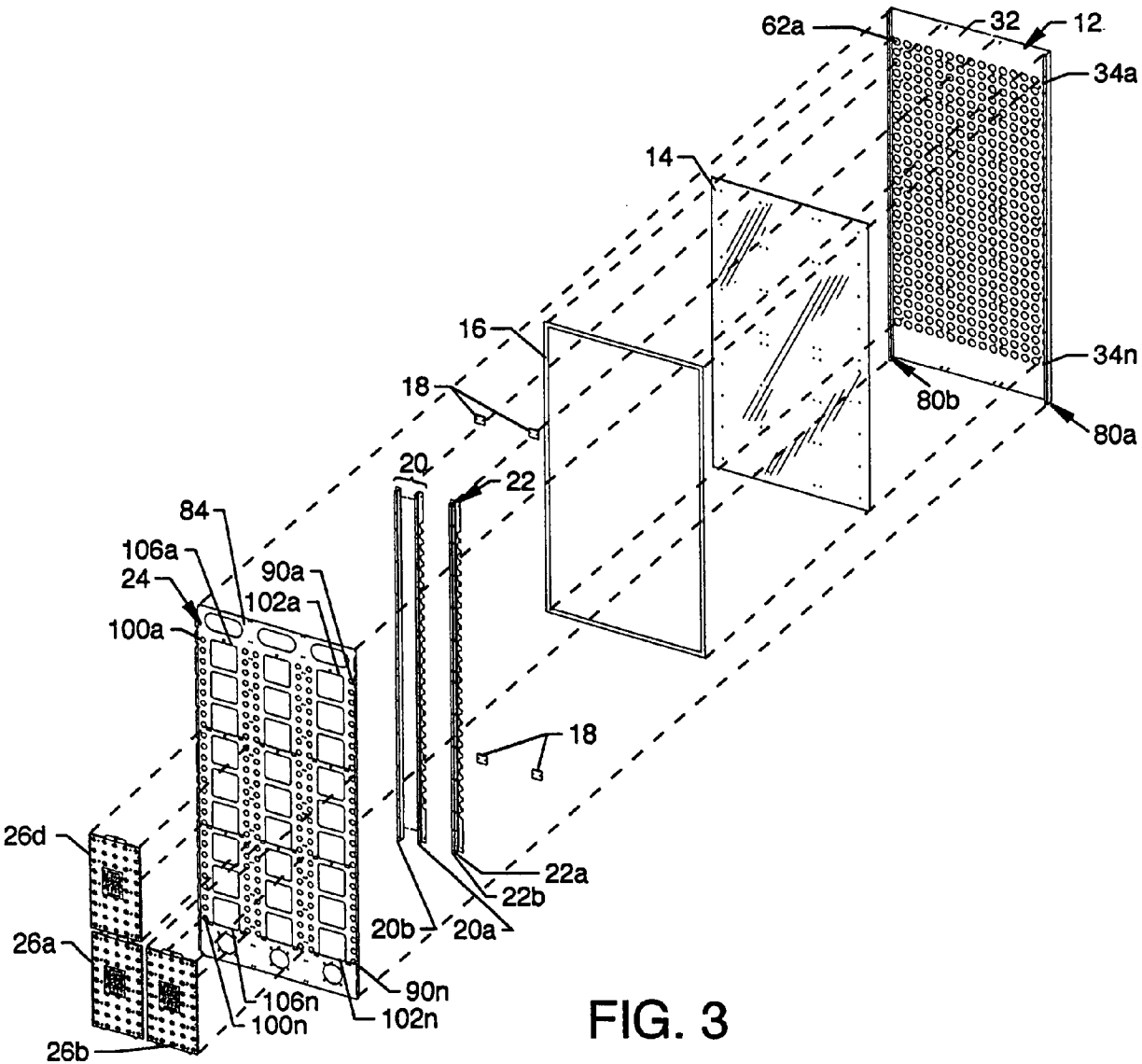
FIG. 3 is an exploded isometric rear view of the electronic display panel.

FIG. 1 is a an isometric front view of an electronic display panel 10, the present invention; FIG. 2 is an exploded isometric front view of the electronic display panel 10; and FIG. 3 is an exploded isometric rear view of the electronic display panel 10. With reference to the aforementioned figures, the electronic display panel 10 includes, from front to back, a front panel 12, a polycarbonate panel 14, a seal 16, a plurality of small spacers 18, vertically oriented spacer bracket assemblies 20 and 22 formed of suitably joined spacer brackets 20*a* and 20*b* and spacer brackets 22*a* and 22*b*, respectively, a rear panel 24, and a plurality of LED modules 26*a*-26*n* of which a small number are shown in FIG. 2. The LED module 26*a* is shown in exploded view to reveal an insertion panel 28 and an LED display panel 30.

Figure 4:
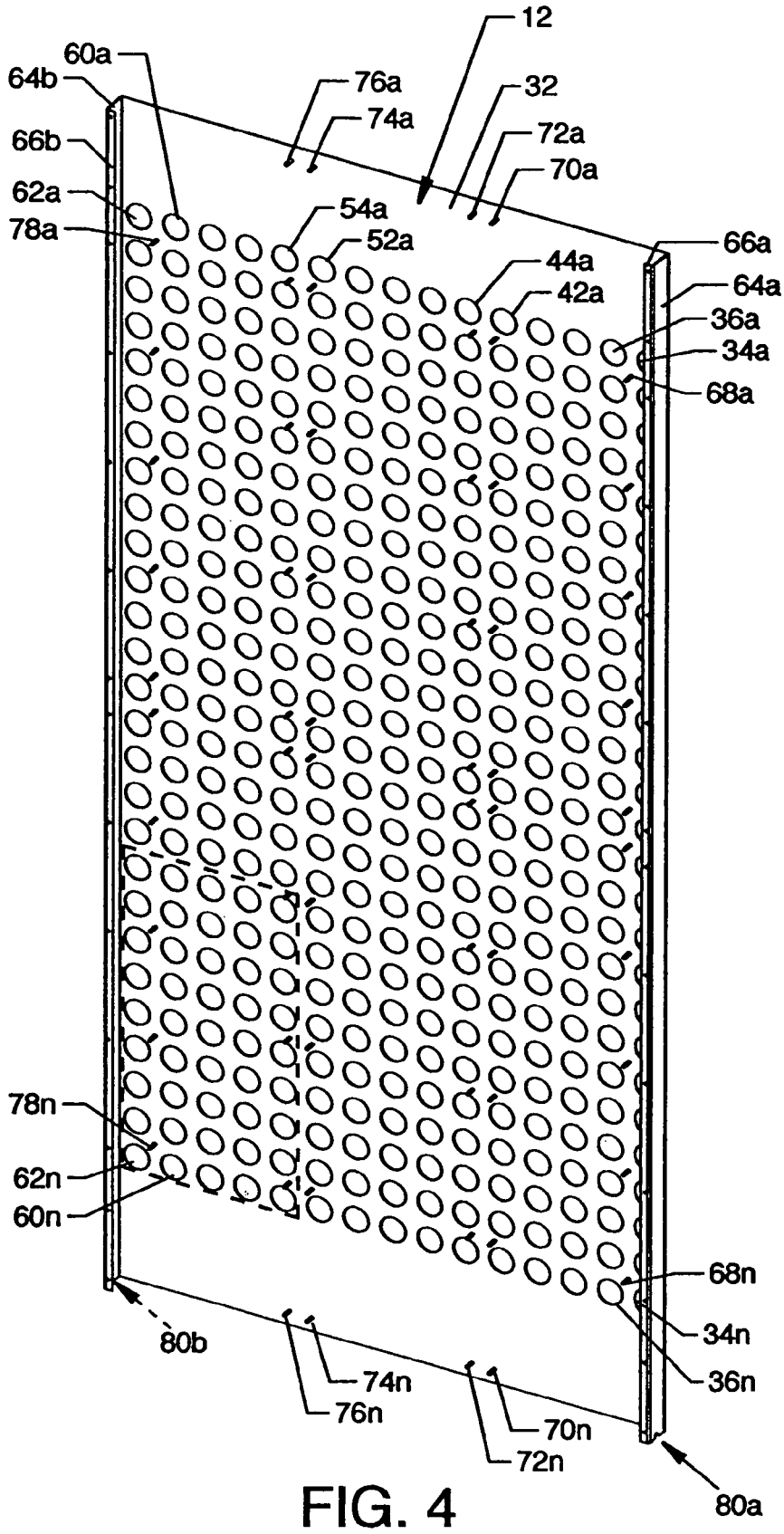
FIG. 4 is an isometric rear view of the front panel.

FIG. 4 is an isometric rear view of the front panel 12 including an apertured planar section 32 with a plurality of spaced circular openings 34*a*-34*n* . . . 62*a*-62*n* arranged in columns for viewing of light emitting diodes (LEDs) or other like devices, opposed edge panels 64*a* and 64*b* extending perpendicularly from the apertured planar section 32, and opposed apertured flanges 66*a* and 66*b* extending perpendicularly from the opposed edge panels 64*a* and 64*b*, respectively. The opposed edge panels 64*a* and 64*b* extending perpendicularly from the apertured planar section 32 and the opposed apertured flanges 66*a* and 66*b* extending perpendicularly from the opposed edge panels 64*a* and 64*b* provide spacing of the apertured planar section 32 with respect to the rear panel 24 in conjunction with the vertically oriented spacer bracket assemblies 20 and 22 which also contribute to structural integrity along, about, through, and within the electronic display panel 10. A plurality of studs 68*a*-68*n* and 78*a*-78*n* or other suitable fasteners arranged in columns extend rearwardly from the apertured planar section 32; and a plurality of studs 70*a*-70*n*, 72*a*-72*n*, 74*a*-74*n* and 76*a*-76*n* arranged in columns extend rearwardly from the apertured planar section 32 to accommodate corresponding mounting holes in the polycarbonate panel 14. The columns of studs 70*a*-70*n*, 72*a*-72*n*, 74*a*-74*n* and 76*a*-76*n* are also utilized for accommodation and mounting of the spacer bracket assemblies 20 and 22 and the plurality of spacers 18. Suitable fastener hardware is incorporated for use with the plurality of studs 68*a*-68*n* and 78*a*-78*n* and the plurality of studs 70*a*-70*n*, 72*a*-72*n*, 74*a*-74*n* and 76*a*-76*n*. Although reference is made to circular openings 34*a*-34*n* . . . 62*a*-62*n*, such openings could be of other shapes and/or sizes and shall not be deemed as limiting to the scope of the invention. Visibly incorporated at the lower portion of the edge panel 64*a* is a notch 80*a* for engagement of a pivot bar of an electronic sign bottom support channel (see application Ser. No. 11/148,461 entitled "Sign System" filed on Jun. 9, 2005, of which the present patent application is a continuation-in-part). Correspondingly, as also incorporated at the lower portion of the edge panel 64*b*, is a similarly shaped notch 80*b* for engagement of the pivot bar of an electronic sign bottom support channel. Similarly shaped notches are also included at the bottoms of the spacer brackets 20*a*, 20*b*, 22*a* and 22*b* comprising spacer bracket assemblies 20 and 22 in alignment with and having a function similar to the notches 80*a* and 80*b*, as described with reference to FIG. 6.

Figure 5:
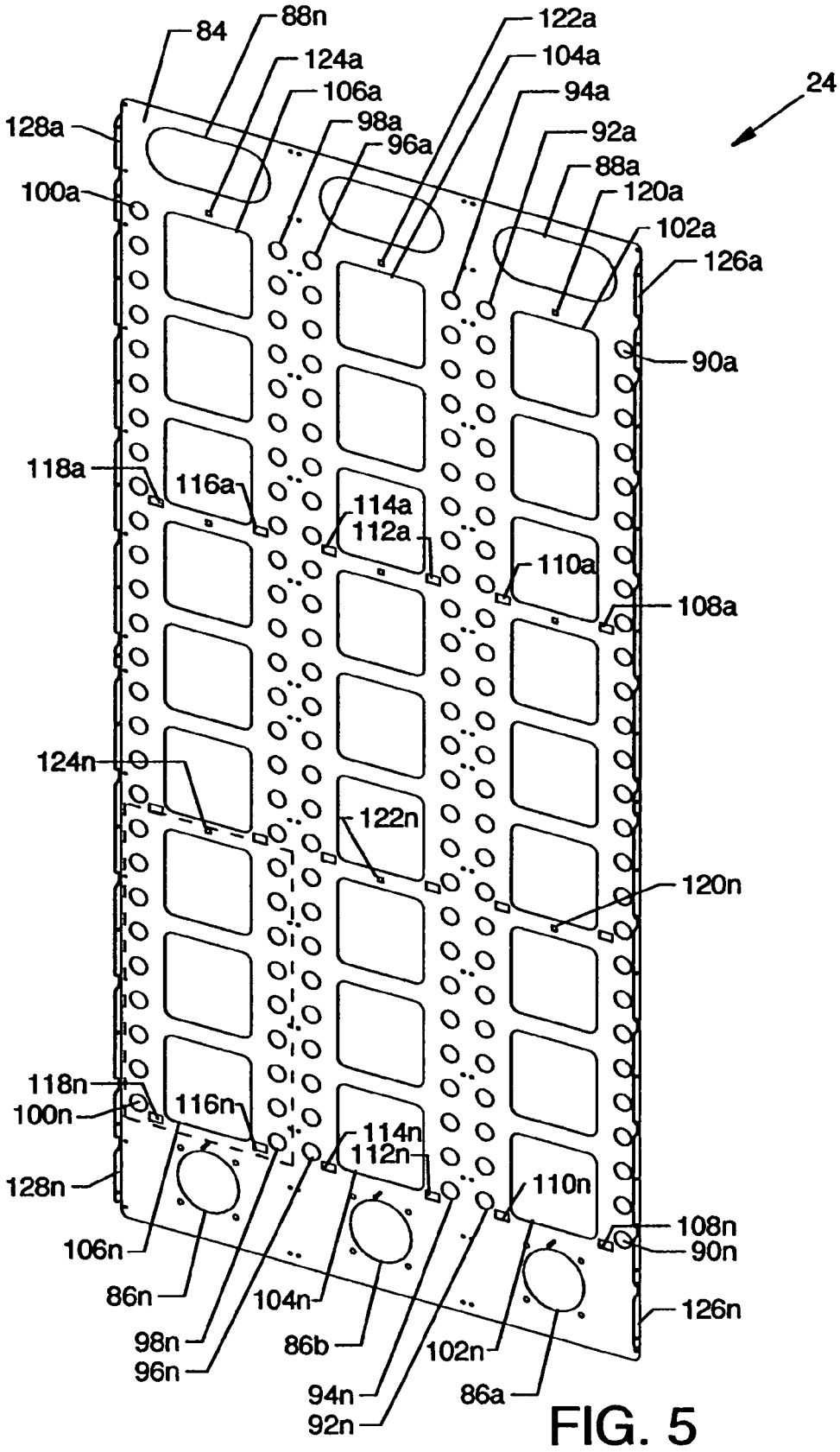
FIG. 5 is an isometric rear view of the rear panel.
Figure 10:
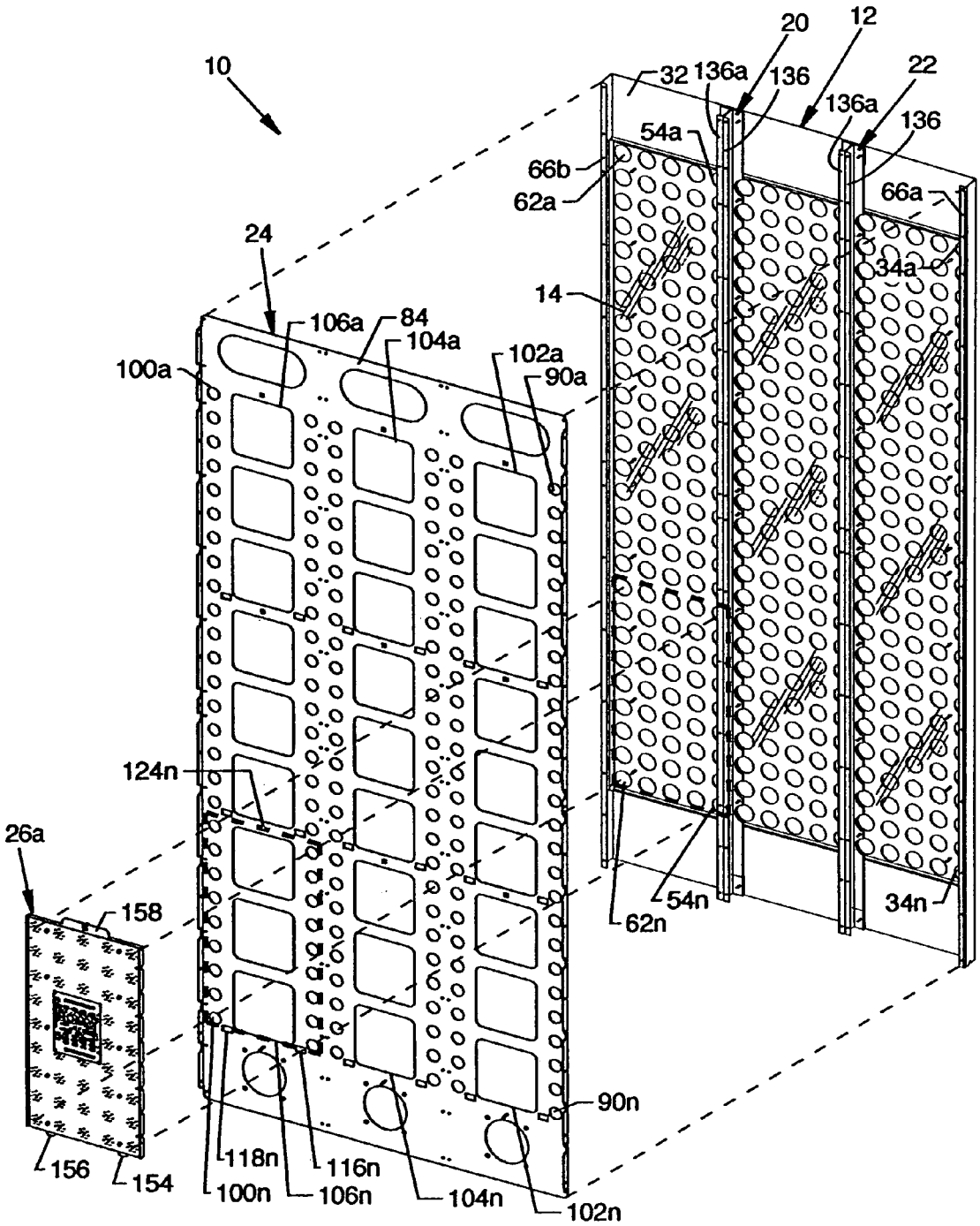
FIG. 10 is an exploded isometric rear view showing the rear panel distanced from the front panel and an LED module distanced from the rear panel.

FIG. 5 is an isometric rear view of the rear panel 24 including an apertured planar section 84 with pluralities of various openings arranged in rows or columns. The apertured planar section 84 includes a plurality of inlet air openings 86*a*-86*n* in a row and a plurality of outlet air openings 88*a*-88*n* in a row located at the bottom portion and the top portion of the apertured planar section 84, respectively, for passage of fan cooling or heating air along and within the electronic display panel 10. The apertured planar section 84 of the rear panel 24 also includes columns of large or small openings which align to one or more, either singularly or collectively, of the plurality of circular openings 34*a*-34*n* . . . 62*a*-62*n* of the front panel 12 which are also arranged in columns. A plurality of circular openings 90*a*-90*n*, 92*a*-92*n*, 94*a*-94*n*, 96*a*-96*n*, 98*a*-98*n* and 100*a*-100*n* which generally are small with respect to a plurality of large substantially square openings 102*a*-102*n*, 104*a*-104*n* and 106*a*-106*n*, each arranged in columns, are arranged on the apertured planar section 84 as shown; i.e., the plurality of square openings 102*a*-102*n* are aligned between the plurality of circular openings 90*a*-90*n* and 92*a*-92*n*, the plurality of square openings 104*a*-104*n* are aligned between the plurality of circular openings 94*a*-94*n* and 96*a*-96*n*, and the plurality of square openings 106*a*-106*n* are aligned between the plurality of circular openings 98*a*-98*n* and 100*a*-100*n*. The large substantially square openings 102*a*-102*n*, 104*a*-104*n* and 106*a*-106*n* include rounded corners each having a radius directly relating to the radius of each of the circular openings 90*a*-90*n*, 92*a*-92*n*, 94*a*-94*n*, 96*a*-96*n*, 98*a*-98*n* and 100*a*-100*n* wherein such radii can be equal but are not required to be equal. The relationship of the radii of the plurality of circular openings 90*a*-90*n*, 92*a*-92*n*, 94*a*-94*n*, 96*a*-96*n*, 98*a*-98*n* and 100*a*-100*n* and of the rounded corners of the plurality of square openings 102*a*-102*n*, 104*a*-104*n* and 106*a*-106*n* is such that the radii of the plurality of circular openings 90*a*-90*n*, 92*a*-92*n*, 94*a*-94*n*, 96*a*-96*n*, 98*a*-98*n* and 100*a*-100*n* and of the rounded corners of the plurality of square openings 102*a*-102*n*, 104*a*-104*n* and 106*a*-106*n* are slightly less than the radii of the plurality of spaced circular openings 34*a*-34*n* 62*a*-62*n* of the front panel 12 in order that viewing of the pixels of the LEDs in the LED modules 26*a*-26*n* from the side is not impaired. A plurality of tab receptors 108*a*-108*n*, 110*a*-110*n*, 112*a*-112*n*, 114*a*-114*n*, 116*a*-116*n* and 118*a*-118*n* arranged in intervals in columns and oppositely located near the lower corners of various square openings 102*a*-102*n*, 104*a*-104*n* and 106*a*-106*n* are included as shown. A plurality of latch receptors 120*a*-120*n*, 122*a*-122*n* and 124*a*-124*n* arranged in intervals in columns and located near the upper edge of various square openings 102*a*-102*n*, 104*a*-104*n* and 106*a*-106*n* are included as shown. Portions of the described columnar square openings 102*a*-102*n*, 104*a*-104*n* and 106*a*-106*n*, circular openings 90*a*-90*n*, 92*a*-92*n*, 94*a*-94*n*, 96*a*-96*n*, 98*a*-98*n* and 100*a*-100*n*, latch receptors 120*a*-120*n*, 122*a*-122*n* and 124*a*-124*n*, and tab receptors 108*a*-108*n*, 100*a*-100*n*, 112*a*-112*n*, 114*a*-114*n*, 116*a*-116*n* and 118*a*-118*n* can be utilized as a group to aligningly and directly and by intimate contact receive structure of and to otherwise interface and secure with and to one or more of the LED modules 26*a*-26*n*. For the purpose of example and illustration, one such group, such as shown in the lower left corner of the rear panel 24, is delineated by a dashed rectangle to include the bottom three square openings of the square openings 106*a*-106*n*, the bottom nine circular openings of the circular openings 100*a*-100*n*, the bottom nine circular openings of the circular openings 98*a*-98*n*, the bottom tab receptors 116*n* and 118*n* of the tab receptors 116*a*-116*n* and 118*a*-118*n*, and the bottom single latch receptor 124*n* of the latch receptors 124*a*-124*n*. Alignment of such openings carries through in indirect and distanced alignment with the nine lower corresponding circular openings in the circular opening columns 54*a*-54*n* . . . 62*a*-62*n* of the front panel 12, such as shown in FIG. 10. The number of included features in a group could be more or less than just described depending on the requirement and size of the LED modules 26*a*-26*n* or the overall requirement and size of the electronic display panel 10. Although reference is made to circular openings 90*a*-90*n*, 92*a*-92*n*, 94*a*-94*n*, 96*a*-96*n*, 98*a*-98*n* and 100*a*-100*n* and to square openings 102*a*-102*n*, 104*a*-104*n* and 106*a*-106*n*, such openings could be of other shapes and/or sizes and shall not be deemed as limiting to the scope of the invention. A plurality of opposed apertured connection tabs 126*a*-126*n* and apertured connection tabs 128*a*-128*n* extend perpendicularly and rearwardly from the apertured planar section 84 and are appropriately spaced in close proximity to the circular openings 90*a*-90*n* and 100*a*-100*n* to preserve constant LED pixel spacing. The apertured connection tabs 126*a*-126*n* and 128*a*-128*n* of adjacent electronic display panels 10 are incorporated to mutually secure, with the inclusion of optional weatherstrip seals, adjacent electronic display panels 10 with the aid of suitable fasteners.

Figure 6:
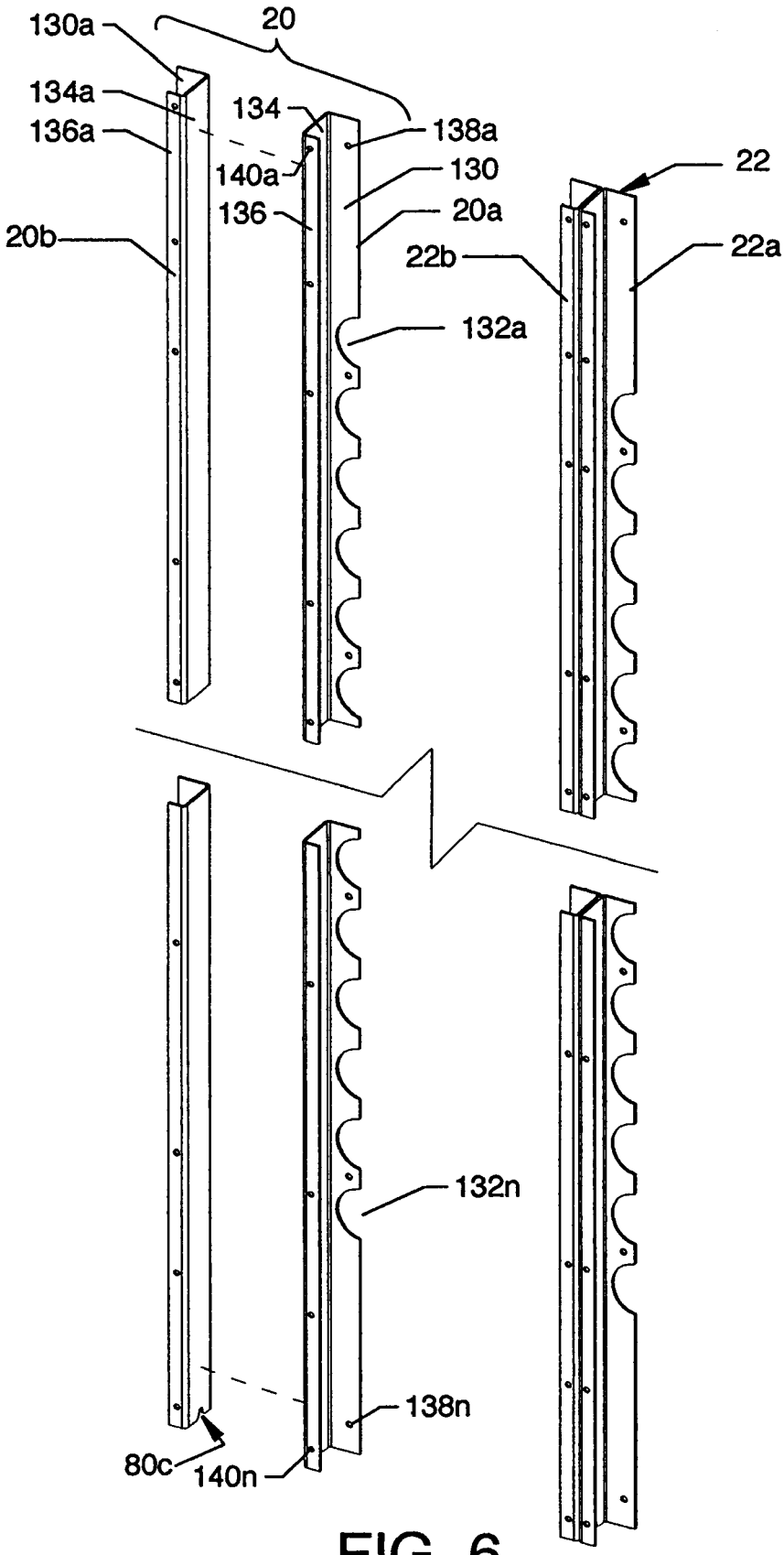
FIG. 6 is a foreshortened isometric rear view of spacer bracket assemblies formed of suitably joined spacer brackets.
Figure 14:
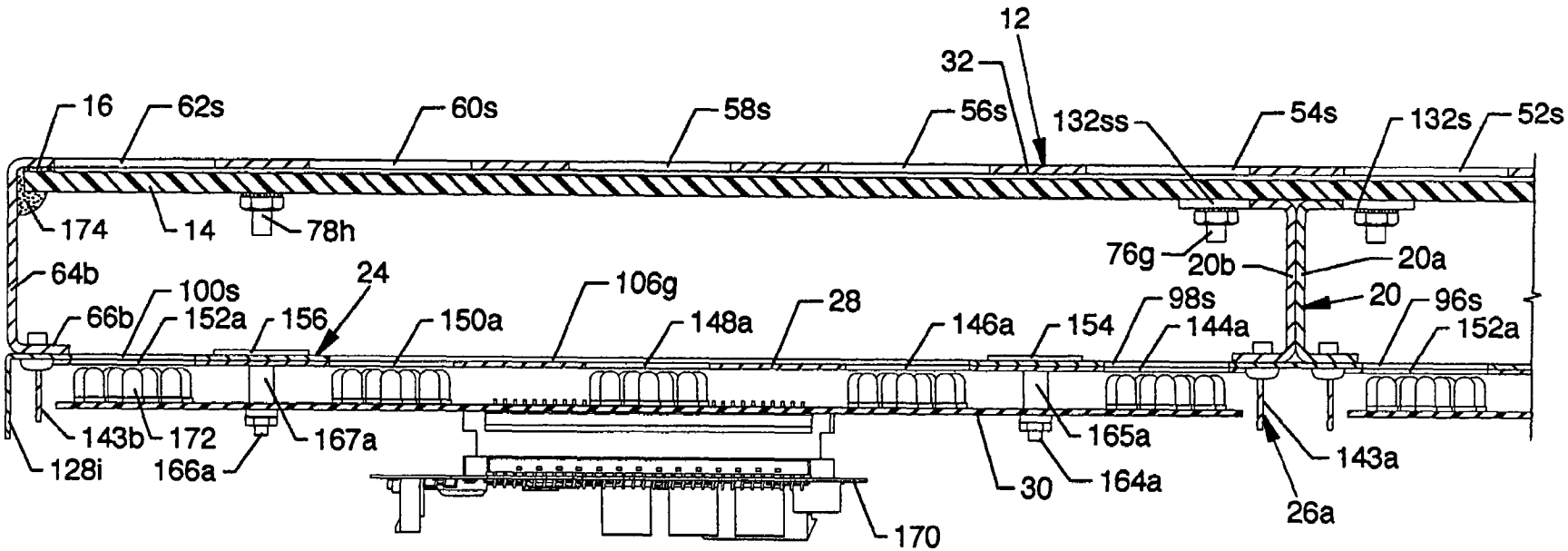
FIG. 14 is a cross section view along line 14-14 of FIG. 13 showing the alignment of LEDs to circular openings of the insertion panel, to circular openings and a square opening, respectively, of the rear panel, and to circular openings of the front panel.

FIG. 6 is a foreshortened isometric rear view of the spacer bracket assemblies 20 and 22 formed of spacer brackets 20*a* and 20*b* (shown separated) and suitably joined spacer brackets 22*a* and 22*b*, respectively. Spacer bracket 20*a* includes a panel 130 interrupted along one edge by a plurality of arcuate recesses 132*a*-132*n* the radius of each of which corresponds to the radius of each of the circular openings of the column of circular openings 52*a*-52*n* of the front panel 12. A panel 134 extends perpendicularly from the other edge of the panel 130. Another panel 136 extends perpendicularly from the panel 134 in the same direction as panel 130, the rearwardly facing surface of which serves as a mounting surface in the same plane as the rearwardly facing surfaces of the apertured flanges 66*a* and 66*b* of the front panel 12 for accommodation and mating of the rear panel 24 thereto. A plurality of suitably located holes 138*a*-138*n* are included along the panel 130 of the spacer bracket 20*a* for accommodation of the studs 74*a*-74*n* extending rearwardly from the front panel 12 and through holes in the polycarbonate panel 14. A plurality of suitably located holes 140*a*-140*n* in the panel 136 are included for mounting the spacer bracket 20*a* to the rear panel 24 using suitable fasteners. The spacer bracket 20*a* aligns to the rear of the polycarbonate panel 14 and to the circular openings of the column of circular openings 52*a*-52*n* of the front panel 12 and in close proximity to the column of circular openings 96*a*-96*n* of the rear panel 24. Spacer bracket 20*b* is a mirror image of spacer bracket 20*a* and has the same features as spacer bracket 20*a*, some of which are referenced, including a panel 130*a*, arcuate recesses 132*aa*-132*nn*, of which arcuate recess 132*ss* is shown in FIG. 14, a panel 134*a* and a panel 136*a* corresponding, respectively, to panel 130, arcuate recesses 132*a*-132*n*, panel 134 and panel 136 of the spacer bracket 20*a*. Spacer bracket 20*b* aligns in corresponding and reverse fashion with the circular openings of the column of circular openings 54*a*-54*n* of the front panel 12 and in near proximity to the column of circular openings 98*a*-98*n* of the rear panel 24 in corresponding alignment thereto. The panels 134 and 134*a* of the spacer brackets 20*a* and 20*b*, respectively, are suitably joined to form a lamination to foster structural integrity.

The structure of the spacer bracket assembly 22 is identical in design and function to that of the spacer bracket assembly 20. The spacer bracket assembly 22 aligns to the rear of the polycarbonate panel 14 and to the circular openings of the columns of circular openings 42*a*-42*n* and 44*a*-44*n* of the front panel 12 and in close proximity to the columns of circular openings 92*a*-92*n* and 94*a*-94*n* of the rear panel 24. Also shown is a notch 80*c* at the bottom of the spacer bracket 20*b*. Each of the spacer brackets 20*a*, 22*a* and 22*b* has a similarly constructed notch.

Figure 7:
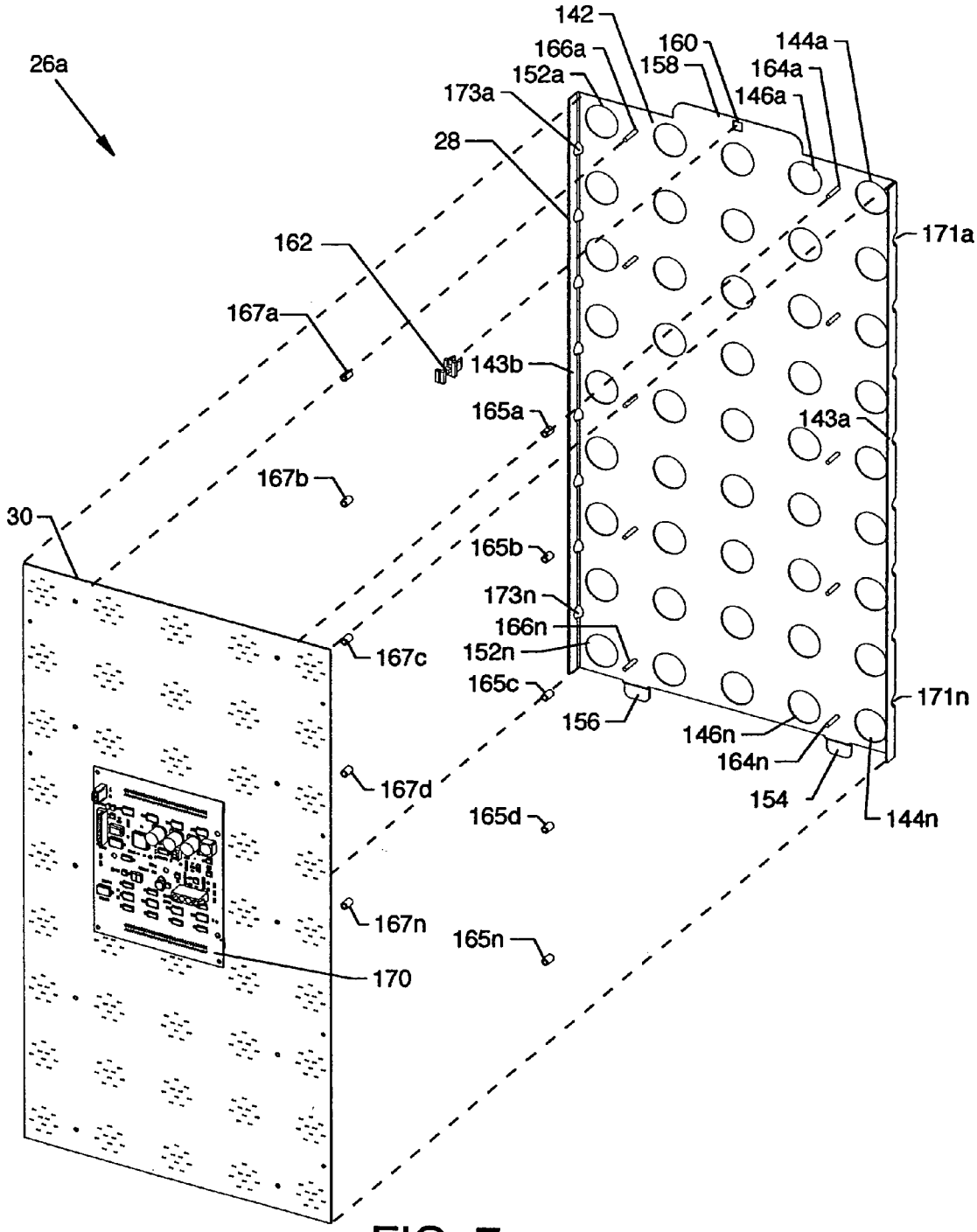
FIG. 7 is an exploded isometric rear view of an LED module including an insertion panel and an LED display panel.

FIG. 7 is an exploded isometric rear view of the LED module 26*a* of the plurality of LED modules 26*a*-26*n* including the insertion panel 28 and the LED display panel 30 which secures to the insertion panel 28. The insertion panel 28 includes an apertured planar section 142 including planar edge panels 143*a* and 143*b* extending perpendicularly therefrom. The apertured planar section 142 has a plurality of spaced circular openings 144*a*-144*n* . . . 152*a*-152*n* arranged in columns to align with LEDs on the forward side of the LED display panel 30, as well as to align to the appropriate circular openings 90*a*-90*n*, 92*a*-92*n*, 94*a*-94*n*, 96*a*-96*n*, 98*a*-98*n* and 100*a*-100*n* and the square openings 102*a*-102*n*, 104*a*-104*n* and 106*a*-106*n* of the rear panel 24. Offset tabs 154 and 156 offset from the plane of the apertured planar section 142 extend from the lower region of the apertured planar section 142 for insertion into and accommodation such as, for example and illustration, by the lowermost tab receptors 116*n* and 118*n* of the pluralities of tab receptors 116*a*-116*n* and 118*a*-118*n* shown in FIG. 5. A planar tab 158 including a latch mount hole 160 extends upwardly from and along the plane of the apertured planar section 142. A rotatable latch 162 installs in the latch mount hole 160 to be further accommodated by, for example and demonstration, the lowermost latch receptor 124*n* of the plurality of latch receptors 124*a*-124*n*. A plurality of studs 164*a*-164*n* and 166*a*-166*n* arranged in columns, including fastener nuts (not shown), extend rearwardly from the apertured planar section 142 to accommodate a plurality of spacers 165*a*-165*n* and 167*a*-167*n* located between the insertion panel 28 and the LED display panel 30. An electronics circuit board 170 is also included on the rear of the LED display panel 30. A plurality of cutouts 171*a*-171*n* are located at the junction of the planar edge panel 143*a* and the apertured planar section 142 and a plurality of cutouts 173*a*-173*n* are located at the junction of the planar edge panel

143*b* and the apertured planar section 142 to accommodate the heads of the rivets (not shown) or other fasteners which fasten the apertured planar section 84 of the rear panel 24 to the apertured flanges 66*a* and 66*b* of the front panel 12 and which accommodate the heads of the rivets (not shown) or other fasteners which fasten the rear panel 24 to the holes, such as holes 140*a*-140*n*, of the spacer bracket assemblies 20 and 22.

Figure 8:
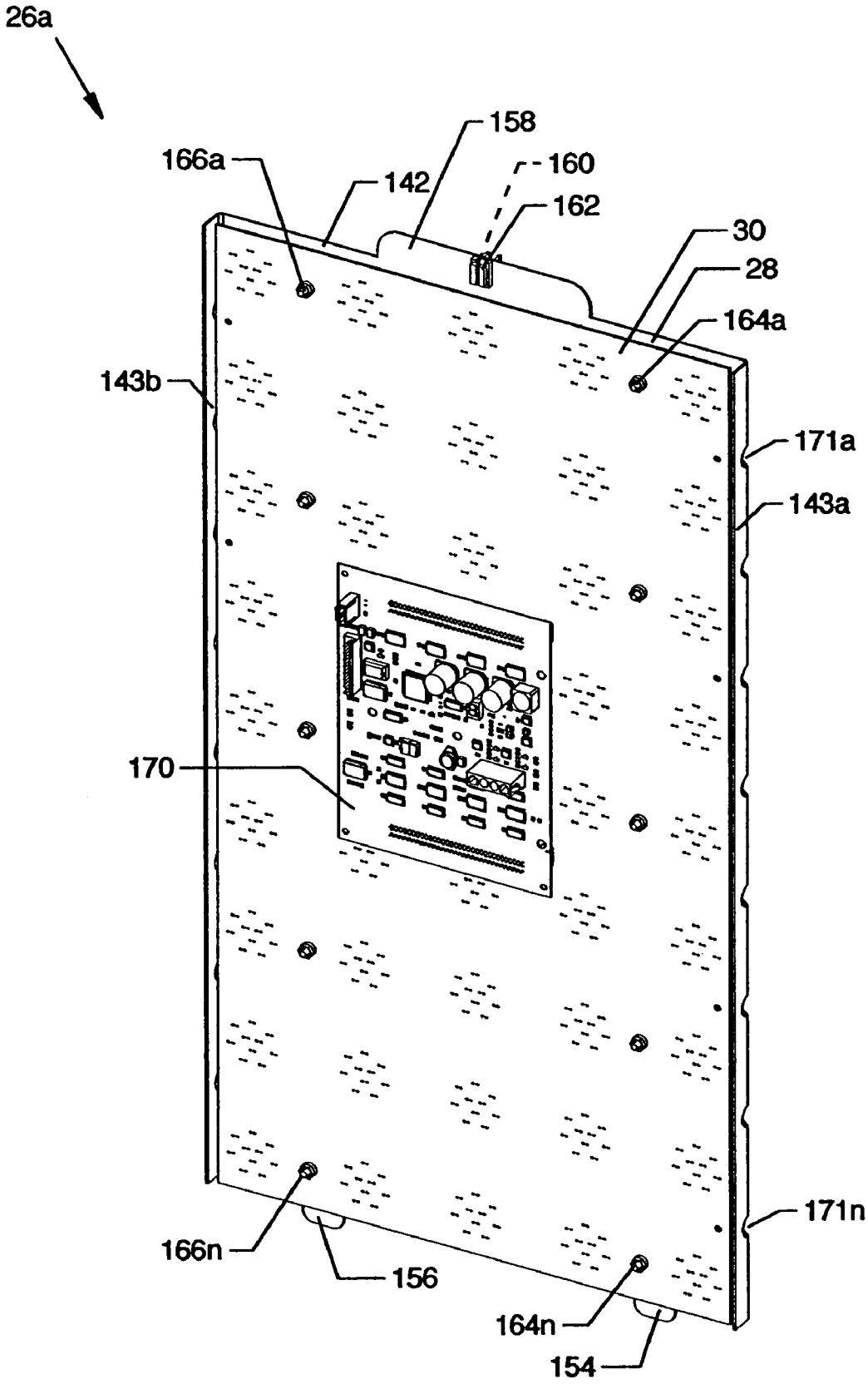
FIG. 8 is an assembled isometric rear view of the LED module of FIG. 7.

FIG. 8 is an assembled isometric rear view of the LED module 26*a*, which is typical of the plurality of LED modules 26*a*-26*n*.

Figure 9:
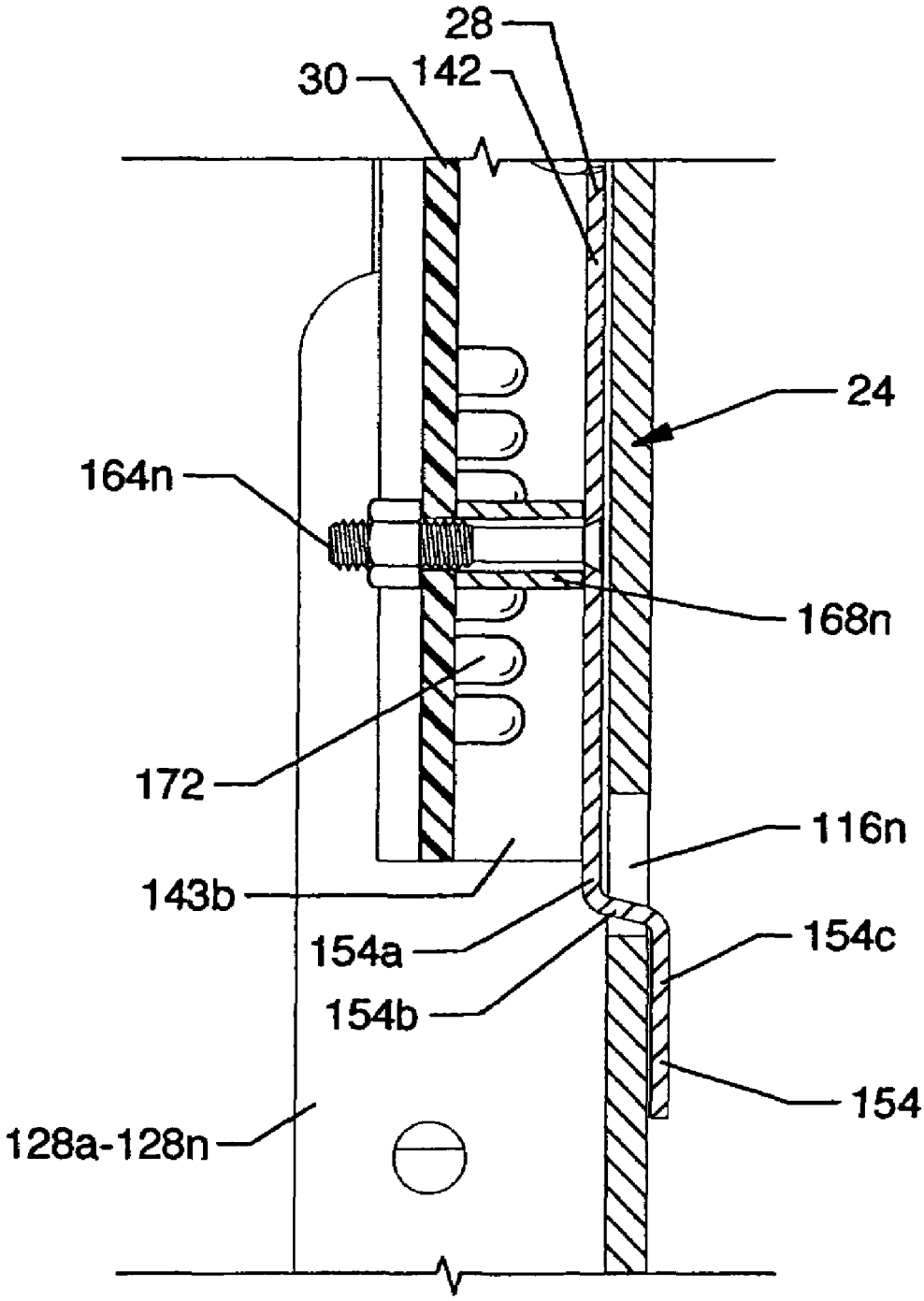
FIG. 9 is a fragmentary view in cross section illustrating the relationship of an offset tab of the insertion panel with a tab receptor of the rear panel.

FIG. 9 is a fragmentary view in cross section illustrating the relationship of the offset tab 154 of the insertion panel 28 with the tab receptor 116*n* of the rear panel 24. The offset tab 154 includes a vertically oriented portion 154*a* extending downwardly from the main body of the apertured planar section 142, an angled portion 154*b* extending downwardly and forwardly from the vertically oriented portion 154*a*, and a downwardly directed vertically oriented portion 154*c* extending from the angled portion 154*b*. The downwardly directed vertically oriented portion 154*c* is first introduced into the tab receptor 116*n* at an angle and urged therethrough followed by further urging to introduce the angled portion 154*b* into the tab receptor 116*n* for alignment therein followed by pivoting of the LED module 26*a*, such as indicated by the arrow in FIG. 15, to complete capture of the offset tab 154 by the tab receptor 116*n*. The offset tab 156 includes similar features and is utilized in the same way. Also shown are a plurality of LEDs 172 secured to the LED display panel 30 in close juxtaposition with the rear of rear panel 24.

FIG. 10 is an exploded isometric rear view showing the rear panel 24 distanced from the front panel 12 and the LED module 26*a* distanced from the rear panel 24. The general alignment of the LED module 26*a* directly to the rear panel 24 and indirectly to the front panel 12 and to the suitable circular openings and square openings of the front and rear panels 12 and 24, respectively, is shown by dashed lines on the front panel 12 and the rear panel 24 and by dashed lines between the LED module 26*a*, the rear panel 24, and the front panel 12, as described previously with reference to FIGS. 4 and 5. The alignment of the remainder of the LED panels 26*b*-26*n* in a similar fashion can occur at adjacent locations. Shown in particular are the spacer bracket assemblies 20 and 22 suitably secured to the rear side of the front panel 12 by the plurality of studs 70*a*-70*n*, 72*a*-72*n*, 74*a*-74*n* and 76*a*-76*n*. The rear panels 136 and 136*a* (FIG. 6) of the spacer bracket assemblies 20 and 22 and the rearwardly located apertured flanges 66*a* and 66*b* of the front panel 12 align in a common plane to present a suitable mounting surface for intimate placement and securing of the apertured planar section 84 of the rear panel 24 thereto.

Figure 11:
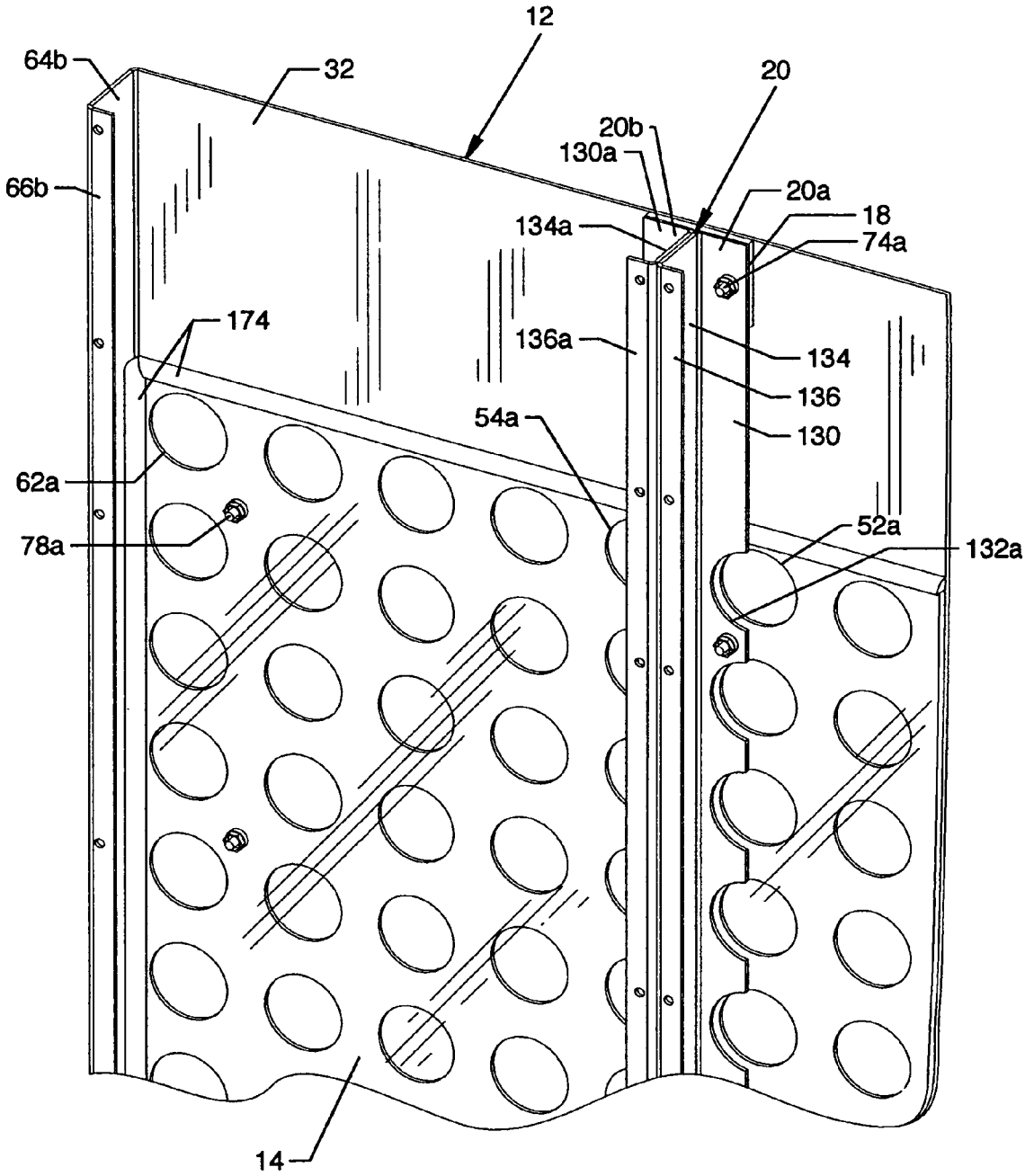
FIG. 11 is an isometric view of an upper corner of the front panel of FIG. 10 showing the alignment of the upper region of a spacer bracket assembly to the upper region of the apertured planar section of the front panel incorporating the polycarbonate panel therebetween and of the upper region of the spacer bracket assembly to the upper region of the apertured planar section incorporating a spacer therebetween.

FIG. 11 is an isometric view of an upper corner of the front panel 12 showing the alignment of the upper region of the spacer bracket assembly 20 to the upper region of the apertured planar section 32 of the front panel 12 incorporating the polycarbonate panel 14 therebetween and of the upper region of the spacer bracket assembly 20 to the upper region of the apertured planar section 42 incorporating a spacer 18 therebetween. The geometrical aspects of the components of the spacer bracket assembly 20 are configured to present a minimum structural profile while still providing structural integrity and suitable viewability of the LED pixels. The spacer brackets 20*a* and 20*b*, being of channel construction, are suitably joined unitarily back to back forming a laminated spacer bracket assembly 20 to offer combined and enhanced structural integrity for use in the electronic display panel 12, while the arcuate recesses 132*a*-132*n* in the panels 130 and 130*a* unrestrictively allow suitable viewing of the LEDs 172 through the circular openings 34*a*-34*n* 62*a*-62*n* of the front panel 12. Adhesive 174 is incorporated, such as shown, to seal the edges of the polycarbonate panel 14 to the rearwardly facing surface of the apertured planar section 32 and to the edge panels 64*a*-64*b*.

Figure 12:
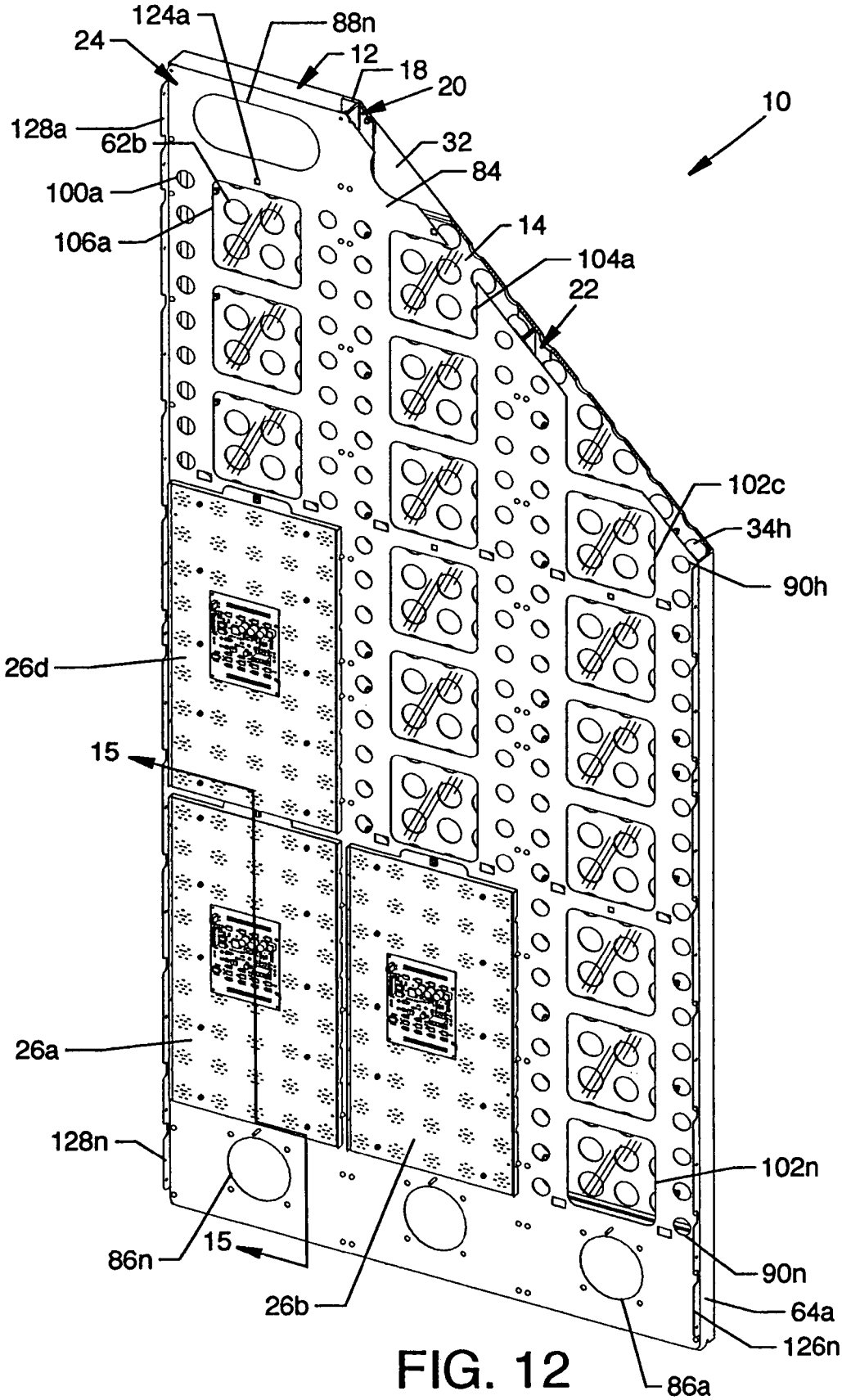
FIG. 12 is a cutaway isometric view of the electronic display panel with LED modules installed at the rear panel.

FIG. 12 is a cutaway isometric view of the electronic display panel 10 with LED modules 26*a*, 26*b* and 26*d* installed at the rear panel 24. Also shown is the relationship of the rear panel 24 to the front panel 12.

Figure 13:
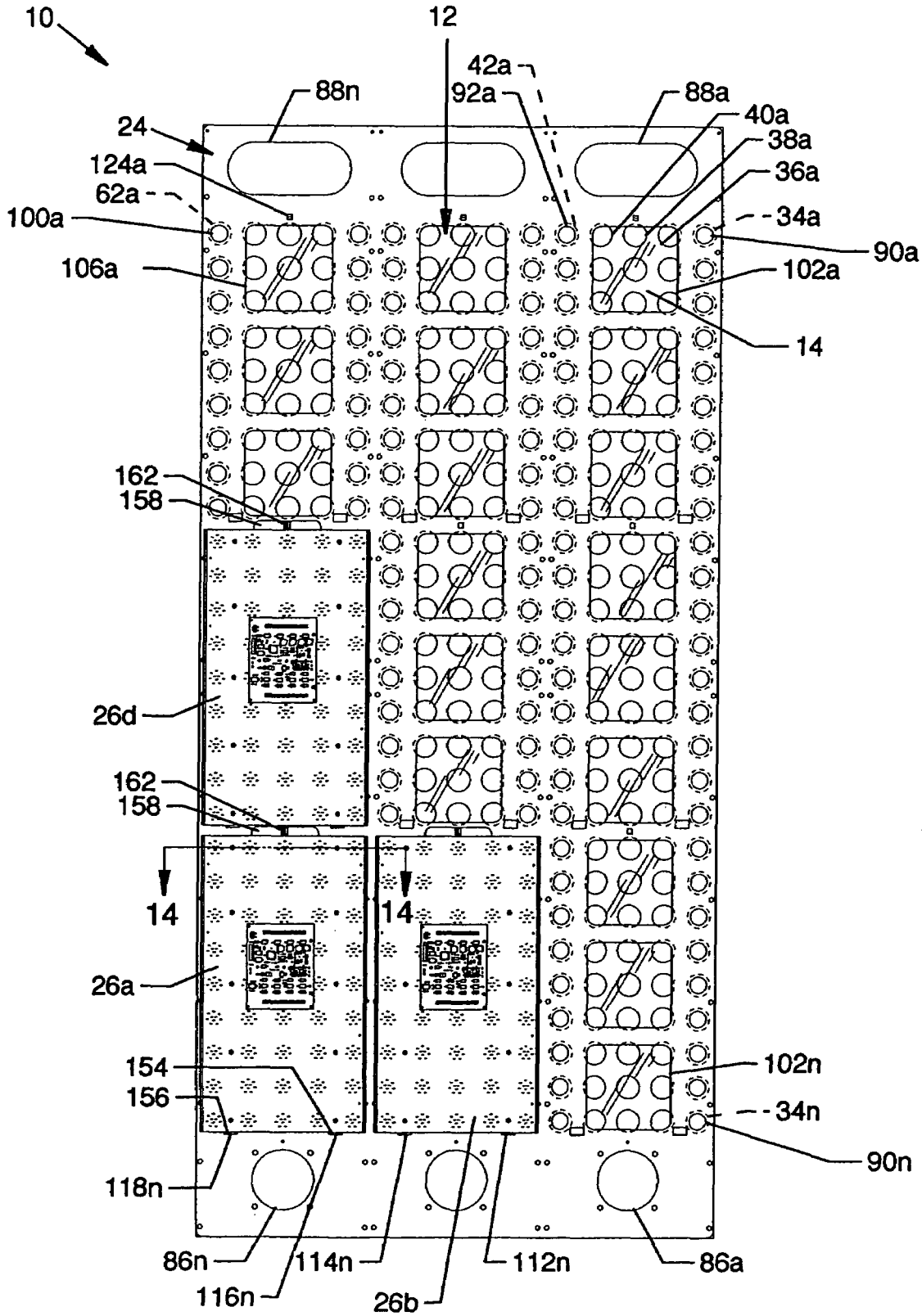
FIG. 13 is a rear view of the electronic display panel with LED modules installed thereupon and showing the relationship of the circular openings of the front panel to both the circular openings and the square openings of the rear panel.

FIG. 13 is a rear view of the electronic display panel 10 with LED modules 26*a*, 26*b* and 26*d* installed at the rear panel 24. Also shown is the relationship of the circular openings 34*a*-34*n* . . . 62*a*-62*n* of the front panel 12 to both the circular openings 90*a*-90*n*, 92*a*-92*n*, 94*a*-94*n*, 96*a*-96*n*, 98*a*-98*n* and 100*a*-100*n* and the square openings 102*a*-102*n*, 104*a*-104*n* and 106*a*-106*n* of the rear panel 24 through which LEDs 172 of the LED modules 26*a*-26*n* are aligned for viewing in a manner described with reference to in FIG. 5. The use of square openings 102*a*-102*n*, 104*a*-104*n* and 106*a*-106*n* in the rear panel 24 provides for weight reduction and for access to the rear side of the polycarbonate panel 14 for the purposes of cleaning subsequent to removal of the one or more LED modules 26*a*-26*n*. For purposes of demonstration and example, access through the top square opening 102*a* would allow direct cleaning of the polycarbonate panel 14 located in near proximity to the top three circular openings of the circular openings 36*a*-36*n*, 38*a*-38*n* and 40*a*-40*n*. Access to the rear side of the polycarbonate panel 14 near the top three circular openings of circular openings 34*a*-34*n* and 42*a*-42*n* is also gained through the top square opening 102*a* and then laterally through the space between the front panel 12 and the rear panel 24.

FIG. 14 is a cross section view along line 14-14 of FIG. 13 showing the alignment of the LEDs 172 to the circular openings 144*a* . . . 152*a* of the insertion panel 28, to the circular openings 98*s* . . . 100*s* and square opening 106*g*, respectively, of the rear panel 24, and to the circular openings 54*s* . . . 62*s* of the front panel 12. Also shown is the alignment of the LED module 26*a* to the rear panel 24 and the alignment of the rear panel 24 to the front panel 12.

Figure 15:
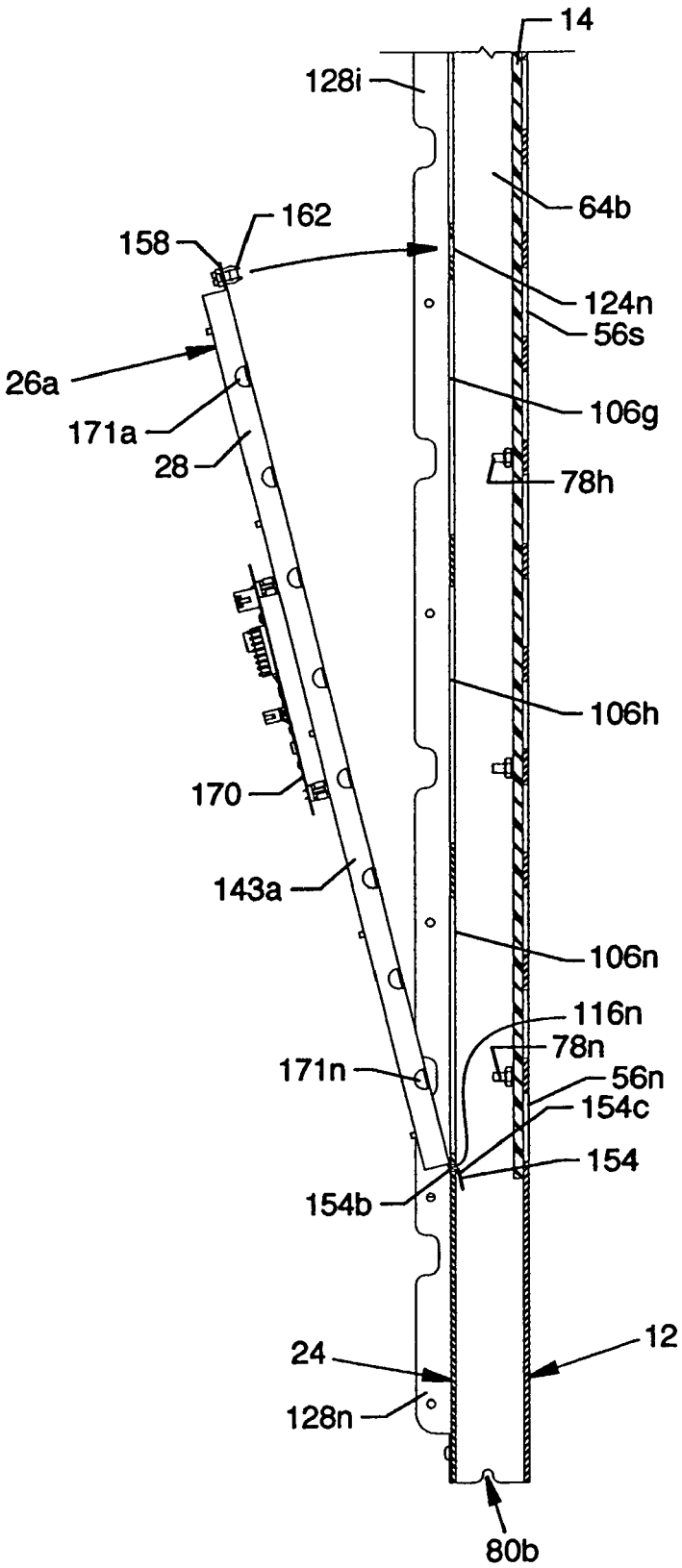
FIG. 15 is a fragmentary view in partial cross section along line 15-15 of FIG. 12 of an LED module during installation to the rear panel; and, FIG. 16 is a view like FIG. 15 but shows the LED module fully maneuvered and pivoted into intimate contact with the rearwardly facing surface of the rear panel.

FIG. 15 is a fragmentary view in partial cross section of an LED module 26*a* during installation to the rear panel 24 which is shown in cross section. The front panel 12 is also shown in cross section where the cross section of the front panel 12 and the rear panel 24 is along line 15-15 of FIG. 12. The LED module 26*a* is first positioned at an angle in close proximity to the rear panel 24 and then maneuvered to introduce the offset tabs 154 and 156 into the tab receptors 116*n* and 118*n*, respectively. Maneuvering of the offset tab 154 in the tab receptor 116*n* is accomplished in the manner described with reference to FIG. 9 where the downwardly directed vertically oriented portion 154*c* is inserted into the tab receptor 116*n* at an angle and urged therethrough followed by further urging and maneuvering to introduce the angled portion 154*b* into the tab receptor 116*n* for alignment therein followed by pivoting of the LED module 26*a*, such as indicated by the arrow in FIG. 15, to complete capture of the offset tab 154 by the tab receptor 116*n*. Maneuvering of the offset tab 156 in the tab receptor 118*n* is accomplished simultaneously in similar manner.

Figure 16:
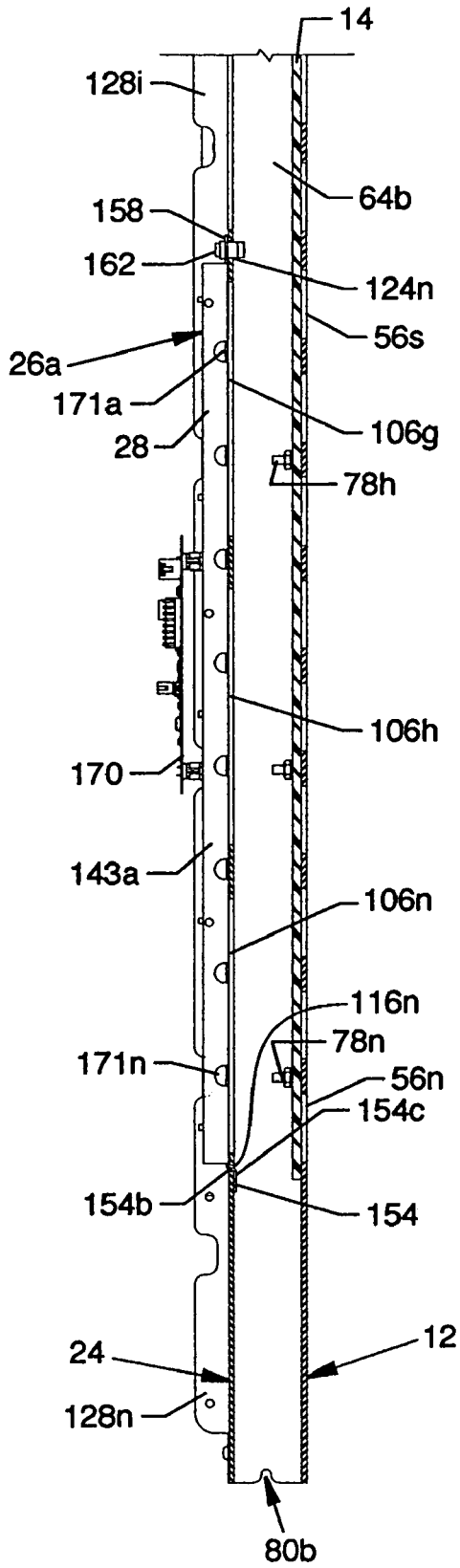

FIG. 16 is a view like FIG. 15 but shows the LED module 26*a* fully maneuvered and pivoted into intimate contact with the rearwardly facing surface of the rear panel 24. During such maneuvering and rotation, one end of the latch 162 is introduced into the latch receptor 124*n* and is subsequently and simply rotated such as by manual grasping and rotation or by engagement of a screwdriver or other suitable tool followed by rotation of the latch, which causes the latch 162 to lockingly engage the latch receptor 124*n*. Three-point attachment of the LED modules 26*a*-26*n* to the rear panel 24 is accomplished as described herein.

Mode of Operation

An electronic display panel 10 can be installed into the frontal geometry of an electronic sign system as shown in patent application Ser. No. 11/148,461 entitled "Sign System" filed on Jun. 9, 2005. During an installation of the electronic display panel 10, the notches 80*a*, 80*b* and corresponding notches at the bottoms of the spacer bracket assemblies 20 and 22 pivotally engage an arcuate surface of a pivot bar and the top of the electronic display panel 10 is secured to the upper region of the frontal geometry of an electronic sign system. LED modules 26*a*-26*n* are secured to the rear panel 24 by the intimate engagement and securing of the offset tabs 154 and 156 with the rear panel 24 and engagement and securing of the latches 162 within the latch receptors 120*a*-120*n*, 122*a*-122*n* and 124*a*-124*n*. Disengagement is provided in the reverse order.

Various modifications can be made to the present invention without departing from the apparent scope hereof.

ELECTRONIC DISPLAY PANEL

Parts List

10 electronic display panel
12 front panel
14 polycarbonate panel
16 seal
18 spacer
20 spacer bracket assembly
20*a*-*b* spacer brackets
22 spacer bracket assembly
22*a*-*b* spacer brackets
24 rear panel
26*a*-*n* LED modules
28 insertion panel
30 LED display panel
32 apertured planar section
34*a*-*n* . . . 62*a*-*n* circular openings
64*a*-*b* edge panels
66*a*-*b* apertured flanges
68*a*-*n* studs
70*a*-*n* studs
72*a*-*n* studs
74*a*-*n* studs
76*a*-*n* studs
78*a*-*n* studs
80*a*-*c* notches
84 apertured planar section
88*a*-*n* inlet air openings
90*a*-*n* outlet air openings
92*a*-*n* circular openings
94*a*-*n* circular openings
96*a*-*n* circular openings
98*a*-*n* circular openings
100*a*-*n* circular openings
100*a*-*n* circular openings
102*a*-*n* square openings
104*a*-*n* square openings
106*a*-*n* square openings
108*a*-*n* tab receptors
110*a*-*n* tab receptors
112*a*-*n* tab receptors
114*a*-*n* tab receptors
116*a*-*n* tab receptors
118*a*-*n* tab receptors
120*a*-*n* latch receptors
122*a*-*n* latch receptors
124*a*-*n* latch receptors
126*a*-*n* apertured connection tabs
128*a*-*n* apertured connection tabs
130 panel
130*a* panel
132*a*-*n* arcuate recesses
132*aa*-*nn* arcuate recesses
134 panel
134*a* panel
136 panel
136*a* panel
138*a*-*n* holes
140*a*-*n* holes
142 apertured planar section
143*a*-*b* planar edge panels
144*a*-*n* . . . 152*a*-*n* circular openings
154 offset tab
154*a* vertically oriented portion
154*b* angled portion
154*c* downwardly directed vertically oriented portion
156 offset tab
158 tab
160 latch mount hole
162 latch
164*a*-*n* studs
165*a*-*n* spacers
166*a*-*n* studs
167*a*-*n* spacers
170 electronics circuit board
171*a*-*n* cutouts
172 LED
173*a*-*n* cutouts
174 adhesive It is claimed:

1. An electronic display panel comprising:

a. a combination of aligned and connected forwardly located components and a plurality of rearwardly located LED (light emitting diode) modules easily and readily secured to the combination of aligned and connected forwardly located components;

b. major forwardly located components including, in order from front to back, a front panel, a seal, a polycarbonate panel, spacer brackets, and a rear panel and rearwardly located LED (light emitting diode) modules; and, c. the rearwardly located LED modules including an insertion panel, the insertion panel having an apertured planar section including a plurality of imperforate offset tabs being located at a lower region of the panel and an opposed tab being located at an upper region of the panel wherein the opposed tab extends upwardly from and along the plane of the apertured planar section, the opposed tab including an opposed latch which readily engages the rear panel of the forwardly located components in three-point attachment, whereby the geometry of the forwardly located components and the rearwardly located components is configured together or separately to offer minimum dimension structure where panels or edges of panels are mated and/or joined with such dimension minimalizing allows uniform spacing of the LED pixels across each of the adjacent LED modules, as well as across adjoining forwardly located components.

2. An electronic display panel comprising:

a. forward combination of aligned and connected components having a rear panel; and, b. a plurality of rearwardly located LED modules, each of the LED modules having a plurality of LEDs arranged thereon, each of the LED modules easily and readily secured to the rear panel of the forward combination of aligned and connected components, each of the LED modules having an insertion panel defining an apertured planar section including:

(1) a plurality of imperforate offset tabs being located at a lower region of the panel; and, (2) an opposed tab being located at an upper region of the panel wherein the opposed tab extends upwardly from and along the plane of the apertured planar section, the opposed tab including an opposed latch which readily engages the rear panel of the forward combination of aligned and connected components in three-point attachment.

3. The electronic display panel of claim 2, wherein the forward combination of aligned and connected components and the plurality of LED modules secured and attached thereto together are characterized by a geometry offering minimum dimension structure where panels or edges of panels are mated.

4. The electronic display panel of claim 2, wherein the forward combination of aligned and connected components includes, in order from front to back:

a. a front panel;

b. a seal;

c. a polycarbonate panel;

d. spacer brackets; and, e. the rear panel.

5. The electronic display panel of claim 3, wherein the geometry allows uniform spacing of the LEDs across each of the adjacent LED modules of the plurality of LED modules.

6. The electronic display panel of claim 3, wherein the electronic display panel adjoins a like electronic display panel and wherein the geometry allows uniform spacing of the LEDs across the adjoining electronic display panels.

7. The electronic display panel of claim 6, wherein the LEDs appear as a seamless LED display presentation having uniform LED spacing when assembled with adjoining electronic display panels.

8. The electronic display panel of claim 3, wherein the spacer brackets are configured in a manner to offer mutual spaced support between the front and rear forwardly located panels and also are constructed for dimension minimalizing such that they will not interfere with the viewing of the LEDs of the LED modules of the plurality of LED modules.

9. The electronic display panel of claim 2, wherein the forward combination of aligned and connected components has a bottom edge and the forward combination of aligned and connected components further includes:

a. a plurality of notches located along the bottom edge for simple engagement of a pivot bar incorporated in a lower structure of a sign system.

10. The electronic display panel of claim 2, wherein the forward combination of aligned and connected components has an upper region and the forward combination of aligned and connected components further includes:

a. means suitable for accommodation by and for securing to an upper structure of a sign system.

11. The electronic display panel of claim 2, wherein the rear panel includes an apertured planar section.

12. The electronic display panel of claim 11, wherein the apertured planar section includes:

a. a plurality of inlet air openings arranged in a row at a bottom portion of the apertured planar section of the rear panel; and, b. a plurality of outlet air openings arranged in a row at a top portion of the apertured planar section of the rear panel.

13. The electronic display panel of claim 12, wherein the inlet air openings and the outlet air openings communicate such that fan cooled or heating air may be past along and within the electronic display panel.

14. The electronic display panel of claim 4, wherein the rear panel includes columnar square openings.

15. The electronic display panel of claim 14, wherein each LED module aligns with three vertically aligned square openings of the columnar square openings.

16. The electronic display panel of claim 14, wherein each of the three vertically aligned square openings of the columnar square openings have rounded corners.

17. The electronic display panel of claim 16, wherein the front panel includes a plurality of spaced circular openings, each overlying and aligning with an LED of the LED modules, and wherein the rounded corners of the square openings of the rear panel have a radii slightly greater than the spaced circular openings of the front panel.

18. The electronic display panel of claim 15, further wherein the front panel includes a plurality of spaced circular openings, wherein nine spaced circular openings of the plurality of spaced circular openings of the front panel align with corresponding square openings of the columnar square openings of the rear panel.

19. The electronic display panel of claim 17, wherein the rear panel further includes circular openings between the columnar square openings.

20. The electronic display panel of claim 15, wherein the rear panel includes a pair of offset tab receptors for receiving the offset tabs of each of the LED modules, which pair of tab receptors are situated adjacent a bottom edge of the lower square opening of the three vertically aligned square openings for each LED module.

21. The electronic display panel of claim 20, wherein the rear panel includes a latch receptor for receiving the opposed latch of each of the LED modules, which latch receptor is situated adjacent an upper edge of the upper square opening of the three vertically aligned square openings for each LED module.

22. The electronic display panel of claim 21, wherein the opposed latch of the LED module is actuated by rotary motion.

23. The electronic display panel of claim 22, wherein the opposed latch of the LED panel is engageable by a rotary hand tool.

24. The electronic display panel of claim 23, wherein the LED modules are installed by pivoting about paired offset tabs engaged in the tab receptors until the opposed latch contacts the latch receptor, then actuating the opposed latch with rotary motion through action of the rotary hand tool.

25. The electronic display panel of claim 23, wherein the LED panel is uninstalled by actuating the opposed latch to disengage from the latch receptor, then pivoting about offset tabs engaged in the tab receptors until the tabs may be separated from the tab receptors.

26. A method of providing an electronic display comprising the steps of:

a. providing an electronic display panel including:

(1) a forward combination of aligned and connected components having a rear panel; and, (2) a plurality of rearwardly located LED modules, each of the LED modules having a plurality of LEDs arranged thereon, each of the LED modules easily and readily secured to the rear panel of the forward combination of aligned and connected components, each of the LED modules having an insertion panel defining an apertured planar section including:

(i)a plurality of imperforate offset tabs being located at a lower region of the panel; and, (ii) an opposed tab being located at an upper region of the panel wherein the opposed tab extends upward from and along the plane of the apertured planar section, the opposed tab including an opposed latch which readily engages the rear panel of the forward combination of aligned and connected components in three-point attachment;

b. installing the electronic display panel in a sign system; and, c. powering selected LEDs of the LED module.

27. The method of claim 26, wherein the electronic display panel further includes notches at the bottom of the electronic display panel, and wherein the sign system includes a pivot bar having an arcuate surface for receiving the notches of the electronic display panel.

28. The method of claim 26, wherein the electronic display panel further includes an upper region and the electronic display panel is secured to the upper region subsequent to pivoting the notches on the arcuate surfaces of the pivot bar.

29. A method of maintaining an electronic display panel, the display panel having a forward combination of aligned and connected components having a rear panel and a plurality of rearwardly located LED modules, each of the LED modules having a plurality of LEDs arranged thereon, each of the LED modules easily and readily secured to the rear panel of the forward combination of aligned and connected components, each of the LED modules including an insertion panel, the insertion panel having an apertured planar section including a plurality of imperforate offset tabs being located at a lower region of the panel and an opposed tab being located at an upper region of the panel wherein the opposed tab extends upwardly from and along the plane of the apertured planar section, the opposed tab including an opposed latch which readily engages the rear panel of the forward combination of aligned and connected components in a three-point attachment, the method comprising the steps of:

a. disengaging the three-point attachment by releasing the opposed latch and subsequently pivoting the insertion panel about the offset tabs to separate the LED module from the rear panel; and, b. engaging an LED module to the rear panel by pivoting the insertion panel about the offset tabs to contact and then engage the opposed latch, and thereby establish the three-point attachment of the LED module to the rear panel.

30. The method of claim 29, wherein the LED module has been repaired between the steps of disengaging and engaging.

31. The method of claim 29, wherein the LED module engaged subsequent to the step of disengaging is a functional LED module.

* * * * *

UNITED STATES PATENT AND TRADEMARK OFFICE

CERTIFICATE OF CORRECTION

PATENT NO. : 7,605,772 B2
APPLICATION NO. : 11/227599
DATED : October 20, 2009
INVENTOR(S) : John W. Syrstad It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1050 days.

Signed and Sealed this

Fifth Day of October, 2010

David J. Kappos

David J. Kappos
*Director of the United States Patent and Trademark Office*